US009816769B1

(12) United States Patent
Brown

(10) Patent No.: US 9,816,769 B1
(45) Date of Patent: Nov. 14, 2017

(54) GAS PISTON FIREARM SYSTEM AND METHOD

(71) Applicant: AMBIMJB, LLC, Baltimore, MD (US)

(72) Inventor: Michael Jay Brown, Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 0 days.

(21) Appl. No.: 15/333,385

(22) Filed: Oct. 25, 2016

(51) Int. Cl.
*F41A 5/00* (2006.01)
*F41A 5/28* (2006.01)
*F41A 21/28* (2006.01)

(52) U.S. Cl.
CPC ..... *F41A 5/28* (2013.01); *F41A 21/28* (2013.01)

(58) Field of Classification Search
CPC ..... F41A 5/26; F41A 5/28; F41A 21/28
USPC ..... 89/191.01, 191.02, 192, 193
See application file for complete search history.

(56) References Cited

U.S. PATENT DOCUMENTS 1,907,164 A * 5/1933 White ..... F41A 3/32 42/16
2,482,880 A * 9/1949 Sefried ..... F41A 5/18 89/17
2,900,878 A * 8/1959 Nomar ..... F41A 3/40 89/189
2,918,847 A * 12/1959 Barr ..... F41A 5/26 42/25
3,592,101 A * 7/1971 Vartanian ..... F41A 5/26 89/193
5,824,943 A * 10/1998 Guhring ..... F41A 5/26 89/192
6,619,592 B2 * 9/2003 Vignaroli ..... F41A 5/18 89/191.01
7,621,210 B2 * 11/2009 Fluhr ..... F41A 5/28 89/193
7,739,939 B2 6/2010 Adams
7,827,722 B1 11/2010 Davies
7,946,214 B2 * 5/2011 Stone ..... F41A 5/18 89/193
7,971,518 B2 7/2011 Adams
8,393,259 B2 * 3/2013 Larue ..... F41A 5/28 89/193
8,528,458 B2 * 9/2013 Windauer ..... F41A 5/26 89/193
8,869,674 B2 * 10/2014 Ruck ..... F41A 5/28 89/193

(Continued)

*Primary Examiner* — Samir Abdosh
(74) *Attorney, Agent, or Firm* — Wood Herron & Evans LLP

(57) ABSTRACT

Provided is a firearm gas operating system. A gas block includes a cylinder housing. A gas actuation piston in the cylinder housing reciprocates between forward and rearward positions and has a head portion with a recess. A switchable gas control valve is insertable into the forward end of the cylinder housing and includes a central passageway open at forward and rear ends. A tubular extension open at opposite ends extends axially rearward from the gas control valve and is configured to be received by the piston head portion recess. Gas pressure diverted from the barrel causes the piston to reciprocate from its forward position, where the head portion recess extends over the tubular extension, to its rearward position, where the head portion recess disengages from the tubular extension, allowing gas to exhaust through the tubular extension and forward end of the control valve to atmosphere.

6 Claims, 5 Drawing Sheets

(56) References Cited

U.S. PATENT DOCUMENTS

| | | | | |
|---|---|---|---|---|
| 8,893,608 | B2 | 11/2014 | Kramer | |
| 9,702,644 | B2 * | 7/2017 | Daley, Jr. | F41A 5/26 |
| 2002/0073832 | A1 * | 6/2002 | Vignaroli | F41A 5/18<br>89/191.01 |
| 2009/0229454 | A1 | 9/2009 | Fluhr et al. | |
| 2010/0251885 | A1 * | 10/2010 | Stone | F41A 5/26<br>89/193 |
| 2014/0076143 | A1 * | 3/2014 | Hall | F41A 19/03<br>89/129.01 |
| 2014/0182450 | A1 * | 7/2014 | Boutin, Jr. | F41A 5/18<br>89/193 |
| 2016/0003566 | A1 * | 1/2016 | Gomirato | F41A 5/28<br>89/193 |

* cited by examiner

GAS PISTON FIREARM SYSTEM AND METHOD

FIELD OF THE INVENTION

This invention relates to a gas pressure operated firearm. In particular, it relates to a gas piston system that allows excess gas pressure to be vented in a forward direction and to a method of assembling a gas flow control valve used in such a system.

BACKGROUND OF THE INVENTION

As is well known, gas-operated auto-loading firearms use a portion of the projectile propellant gases to cycle the firearm action, extracting and ejecting the spent casing and automatically loading another cartridge into the barrel chamber. A small portion of the propellant gas pressure is diverted through a port from the barrel bore and through a gas block mounted on the barrel. In a direct impingement system, a flow of gas pressure is conveyed directly into the bolt carrier to cycle the action. In gas piston systems, the gas is used to actuate a piston that is either directly (long stroke) or indirectly (short stroke) connected to the bolt carrier assembly by an operating rod.

In some known gas piston systems, after the piston has been actuated, the remaining gas pressure may not be vented, in which case it returns through the barrel gas port into the barrel bore and exhausts with the rest of the propellant gas pressure through the muzzle. In other systems, after the piston has been displaced a preselected distance, gas may be vented through an exhaust port in the cylinder wall. In some cases, this results in venting of hot propulsion gases inside a forearm or hand guard, causing a significant transfer of heat to an area where the user commonly places a hand for supporting the firearm. Alternatively, other systems have provided a forwardly directed gas exhaust vent, but these systems have required complex machining to manufacture the parts, have been difficult or cumbersome to disassemble, and/or have been difficult to thoroughly clean.

SUMMARY OF THE INVENTION

The present invention provides a gas operating system for a firearm having a barrel with an axial bore and a gas port. A gas block is provided on the barrel and includes a gas block passageway operatively connected with the gas port and a cylinder housing extending axially substantially parallel to the barrel bore and open at forward and rear ends. A gas actuation piston is insertable through the open forward end of the cylinder housing to operably reciprocate in the cylinder housing between a forward at rest position and a rearward actuated position. The piston has a head portion with a recess including an open forward end and closed rearward end. A switchable gas control valve is insertable into the open forward end of the cylinder housing. The valve includes a central passageway open at forward and rear ends and a plurality of separate gas flow control orifices are selectively positioned to control gas flow from the gas block passageway to an interior chamber in the cylinder housing defined between the control valve and gas actuation piston. A tubular extension open at opposite ends axially extends rearward from the gas control valve. The tubular extension is configured to be received by the open forward end of the piston head portion recess, such that gas pressure from the barrel bore causes the piston to reciprocate from its forward position, where the head portion recess extends over and occludes the tubular extension, to its rearward position, where the head portion recess disengages from the tubular extension, allowing gas to exhaust through the tubular extension and forward end of the control valve to atmosphere.

According to a method of the present invention, the central passageway of the gas control valve may be provided with a bulkhead defining forward and rearward portions of the central passageway with a bore therethrough. A tubular extension member having a first exterior portion with a first diameter sized to closely fit the bore of the bulkhead and a second exterior portion axially spaced from the first portion and having a second diameter greater than the first diameter with an annular shoulder defined between the first and second exterior portions may be provided. The first exterior portion of the tubular extension member may be inserted through the bulkhead bore from the rearward portion of the central passageway such that the annular shoulder abuts the bulkhead. And a portion of the first exterior portion extending through the bulkhead bore may be flared to secure the tubular extension member to the gas control valve.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawings, wherein.

DETAILED DESCRIPTION OF THE INVENTION

Figure 1:
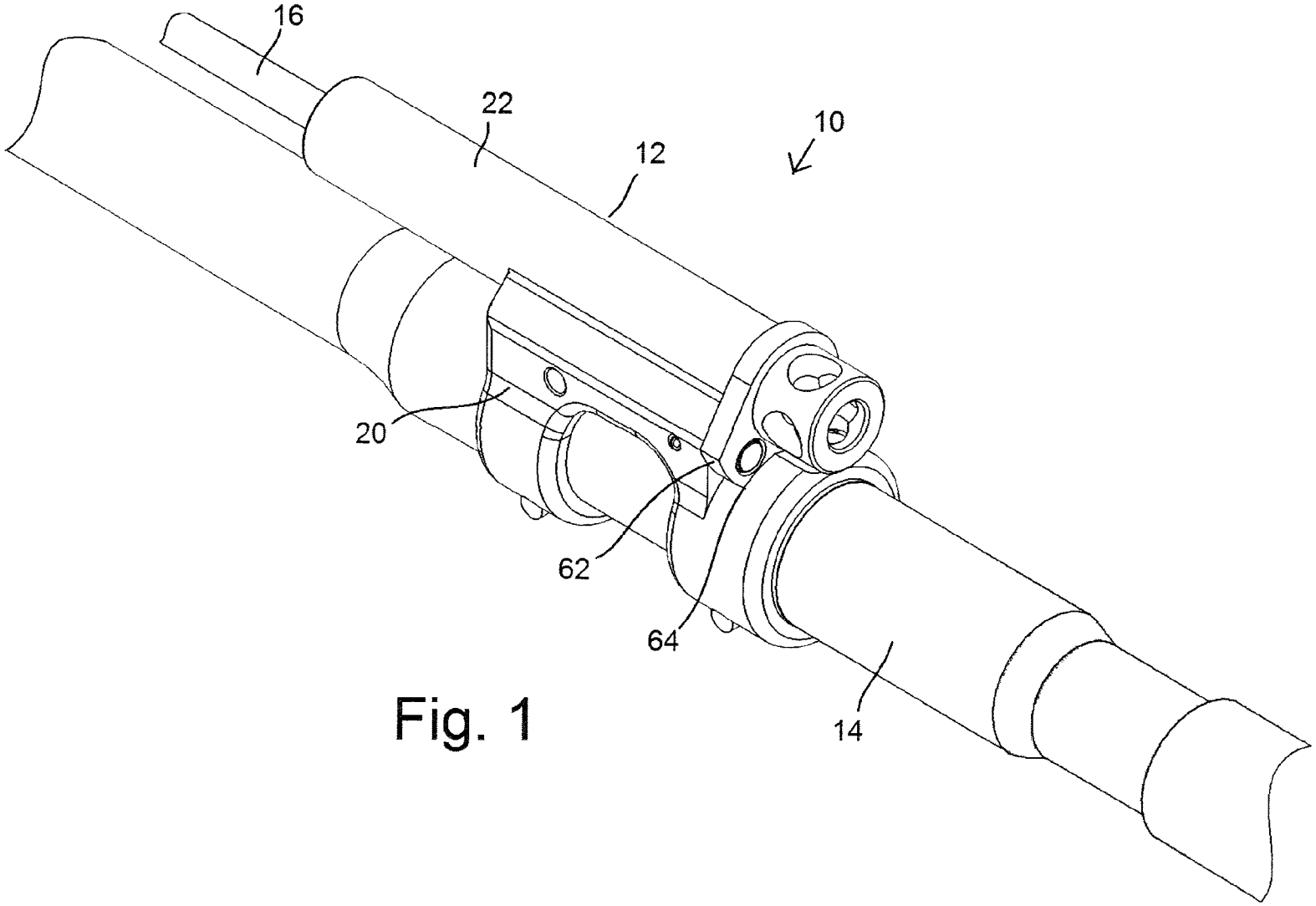
FIG. 1 is a fragmentary isometric view of a firearm gas piston system according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIG. 1, therein is shown at 10 a gas operating system for a firearm according to one embodiment of the present invention. The system 10 includes a gas block assembly 12 mounted to a firearm barrel 14. The system 10 actuates an operating rod 16, which reciprocates axially to cycle the action (not shown) of the firearm.

Figure 2:
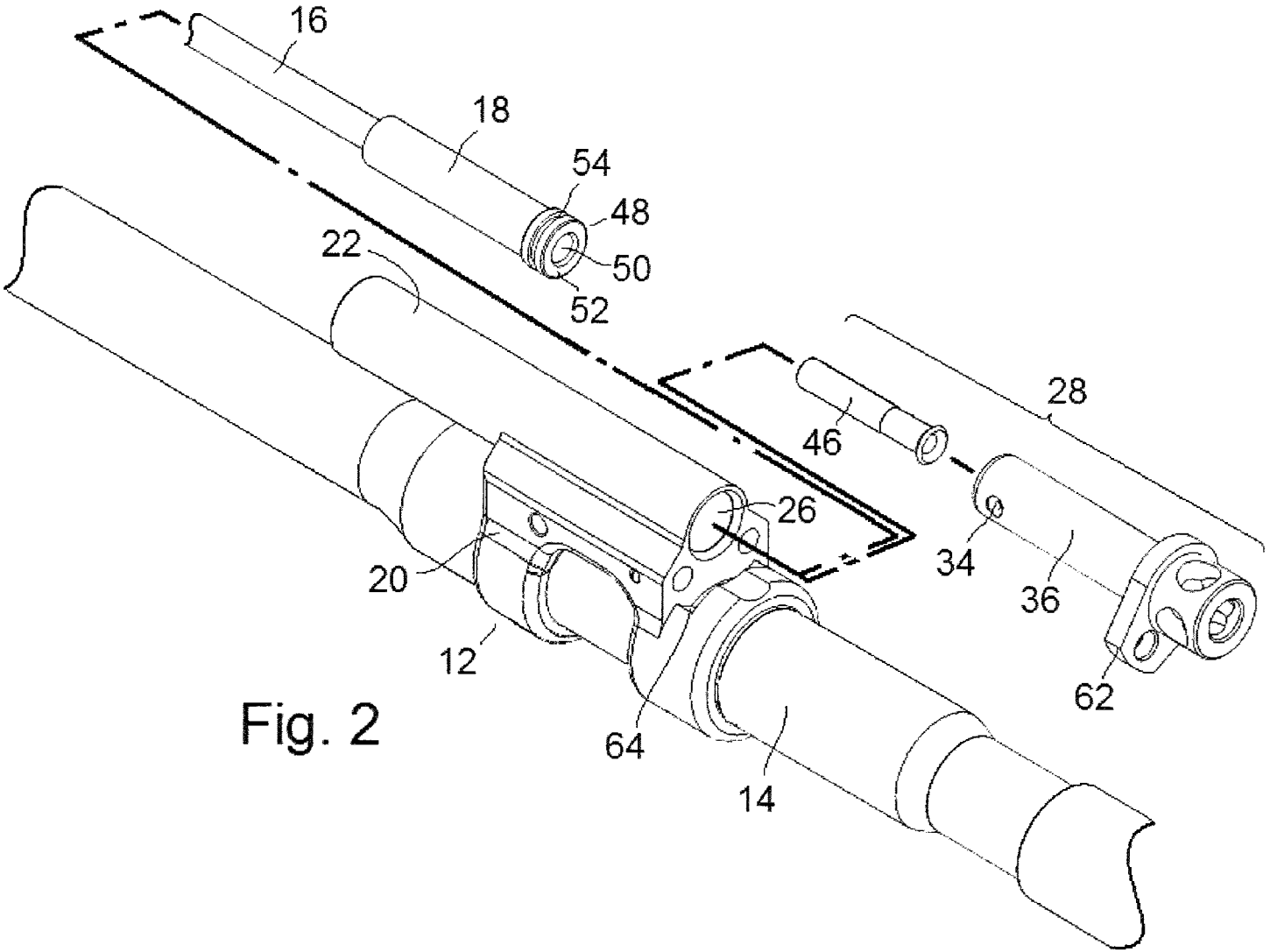
FIG. 2 is an exploded isometric view thereof.
Figure 3:
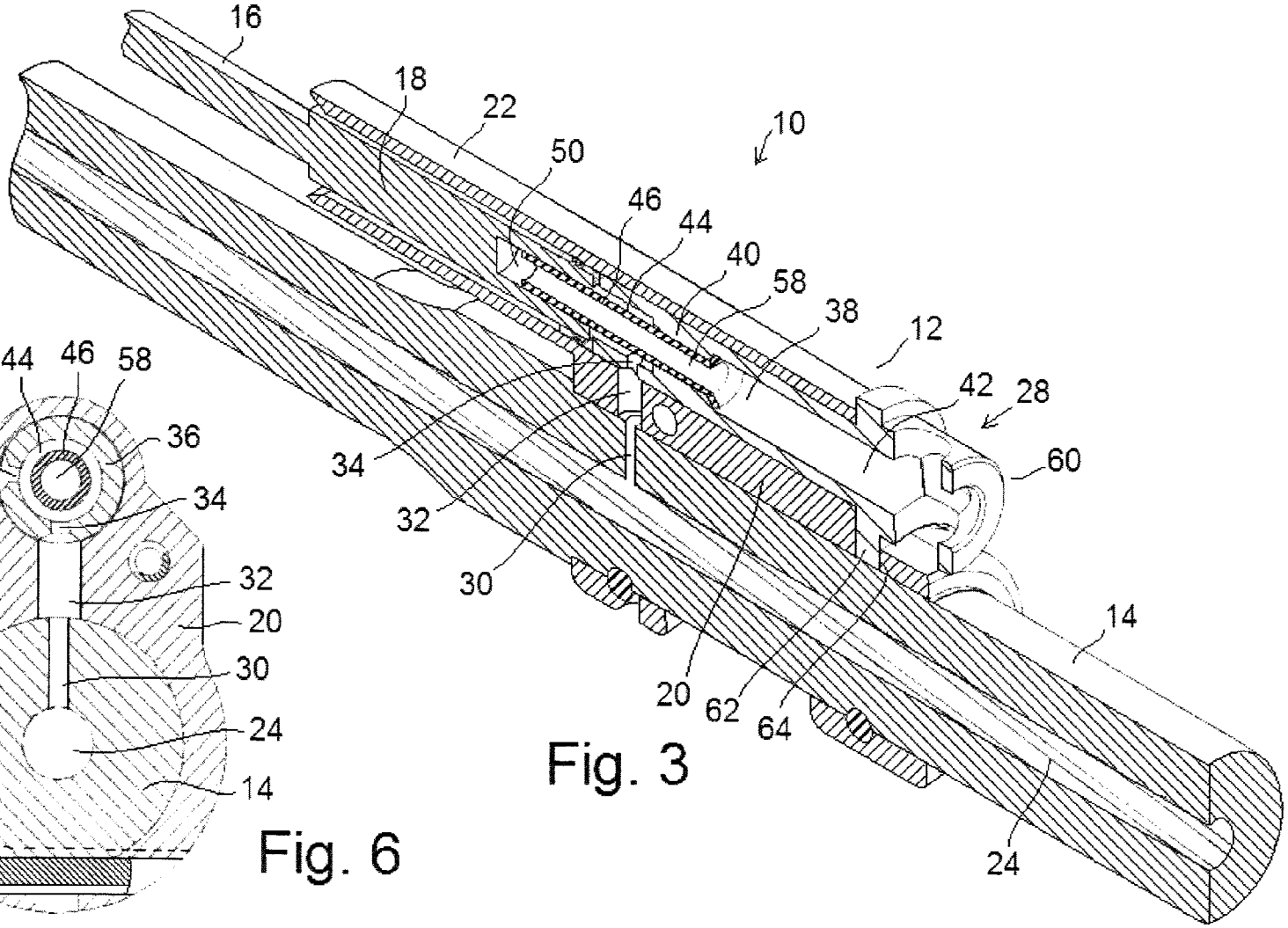
FIG. 3 is a longitudinally sectioned isometric view thereof.

Referring also to FIGS. 2 and 3, a gas piston 18 may be directly or indirectly connected to the operating rod 16. The gas block 12 may include a main body 20 and a cylinder housing 22 longitudinally oriented substantially parallel to the bore 24 of the barrel 14. As illustrated in FIG. 2, the piston 18 and operating rod 16 may be inserted and removed from a forward open end 26 of the cylinder housing 22. Also insertable through the forward open end 26 is a gas flow control valve assembly 28. The construction and assembly method of the control valve assembly 28 will be described separately in more detail, below.

Figure 4:
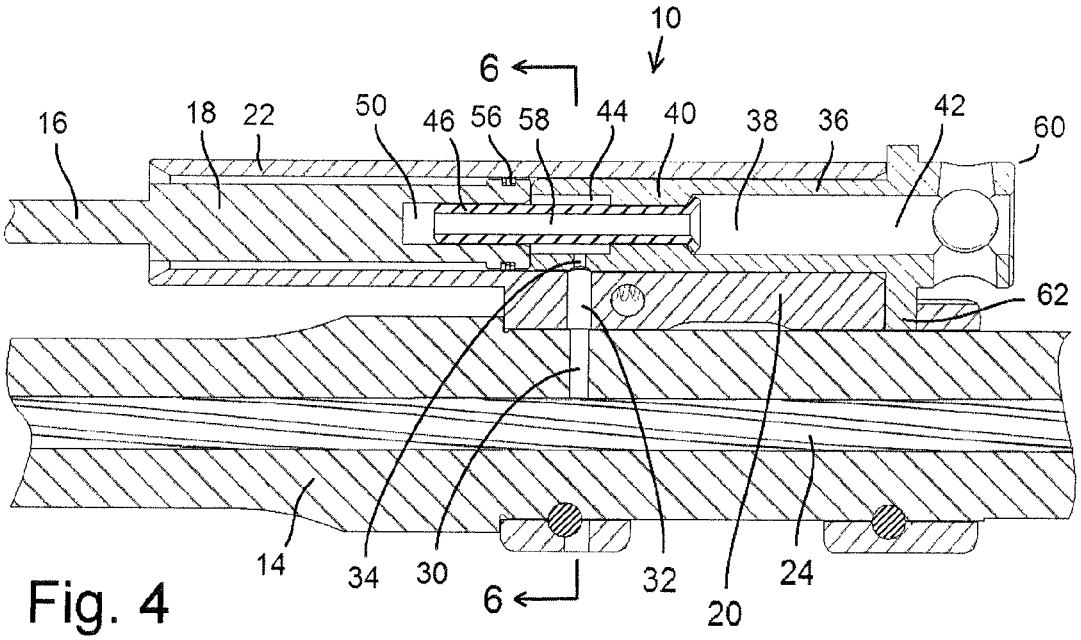
FIG. 4 is a side sectional view thereof showing the gas piston in a forward, at-rest position.

Referring now in particular to FIGS. 3 and 4, the cylinder housing 22 can have a uniform interior diameter along its entire length. This would allow easy cleaning of the interior surfaces of the cylinder housing 22 with access simply by removal of the control valve assembly 28 and piston/operating rod 16, 18.

Figure 6:
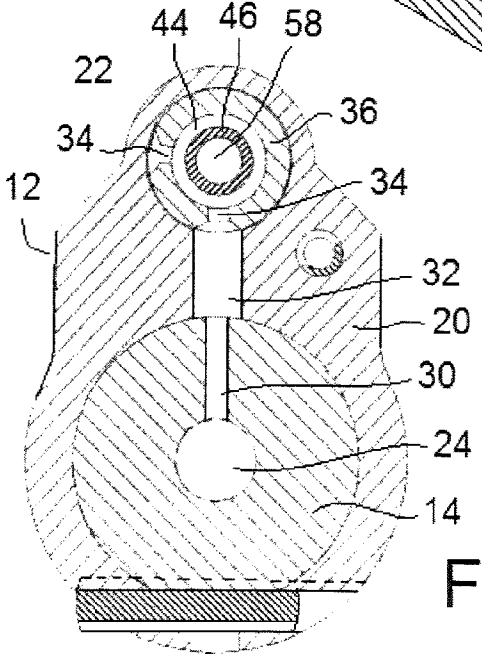
FIG. 6 is a cross-sectional view taken substantially along lines 6-6 of FIG. 4.

In operation, a portion of propellant gas pressure is vented through a barrel port 30 which allows gas flow from the bore 24 into a gas block passage way 32. Gas flow may be controlled by selection between one or more orifices 34 that may be provided in the control valve body 36. As illustrated in FIG. 6, multiple orifices 34 of varied size may be radially oriented and circumferentially spaced in the control valve body 36. Selection of a particular orifice 34 may be made by axial rotation of the control valve assembly 28.

The control valve body 36 has an axial through-passage way 38. A bulkhead portion 40 divides the through-passage way 38 into forward and rear chambers 42, 44. A tubular extension 46 projects rearwardly from the bulkhead portion 40, giving the rear chamber 44 an annular configuration. The orifices 34 may be selectively positioned to control flow from the gas block passage way 32 into this annular rear chamber 44. The construction and assembly method of the tubular extension 46 and control valve body 36 will be described in more detail, below.

A head portion 48 of the piston 18 may include a recess 50 configured to receive at least a portion of the tubular extension 46 that extends axially beyond the control valve body 36. The recess 50 is substantially axially oriented with an open end at the piston face 52 and a closed bottom. The head portion 48 may also include a series of gas check grooves (not shown) and/or an annular groove 54 configured to receive a plurality of seal rings 56. The rings 56 can closely contact and slide against the interior surface of the cylinder housing 22, creating a seal, and allowing the head portion 48 of the piston 18 to fit more loosely within the cylinder housing 22, providing a more reliable seal while reducing friction and wear.

Figure 5:
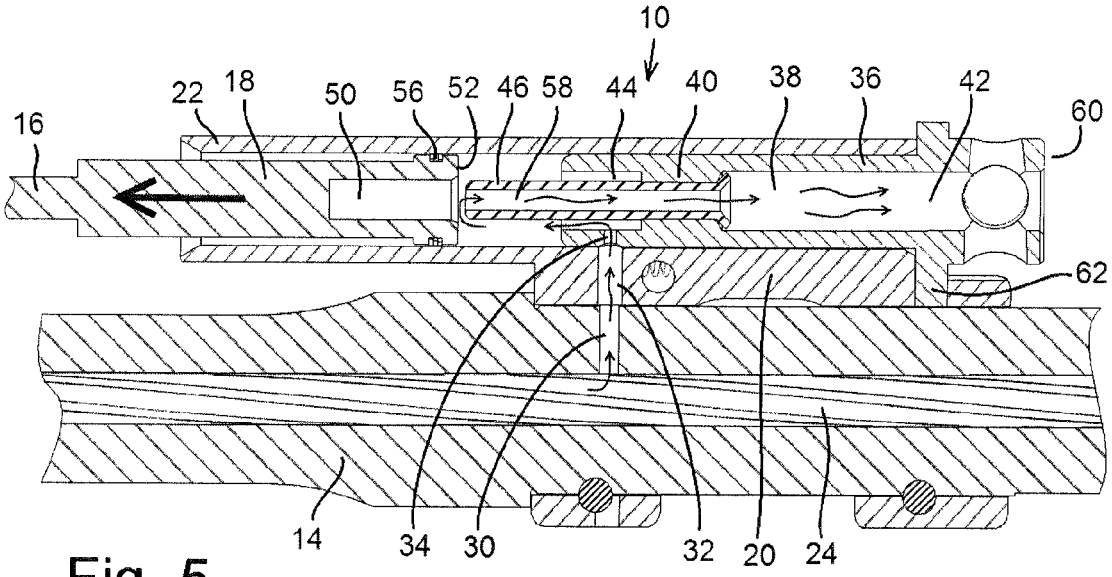
FIG. 5 is a side sectional view showing the gas piston in a rearwardly displaced, actuated position.

Referring now in particular to FIGS. 4 and 5, when the piston 18 is in a forward, at-rest position (FIG. 4) the recess 50 in the head portion 48 receives the tubular extension 46, occluding the tubular extension passage way 58 against gas flow. As propellant gas pressure is vented from the barrel bore 24 through the barrel port 30, gas block passage way 32, and orifice 34 into the rear chamber 44, fluid pressure is applied against the piston face 52. This fluid pressure causes the piston 18 to cycle rearwardly, as shown in FIG. 5, expanding the fluid chamber within the cylinder housing 22. When the piston 18 has been displaced a preselected distance (for example, 0.625"), transferring axial movement to the operating rod 16 to retract the firearm action (not shown), the tubular extension 46 separates from the recess 50, opening the tubular extension passageway 58 and allowing fluid pressure within the cylinder chamber to vent through the tubular extension 46, into the forward chamber 42, and out the open forward end 60 of the control valve body 36 to atmosphere. As used herein, "atmosphere" means any area surrounding the gas operating system 10 that is not configured to contain fluid pressure and which can accept the venting of excess propulsion gases without any significant change in pressure.

As depicted in FIGS. 1 and 2, the gas flow control valve assembly 28 may be axially retained within the cylinder housing 22 by engagement of a radially extending tab 62 in a retention groove 64 provided in the gas block main body 20 adjacent the open forward end 26 of the cylinder housing 22. The control valve assembly 28 may be rotated, for example approximately 270 degrees, between positions where a selected orifice 34 is radially aligned with the gas block passage way 32. At either position, the tab 62 engages the retention groove 64. The control valve assembly 28 may be detained at either of the selected positions by means of a detent mechanism (not shown). At an intermediate position of rotation, the control valve assembly 28 may be axially removed from the cylinder housing 22. As described before, after removal of the control valve assembly 28, the piston 18 and operating rod 16 may also be removed axially through the open forward end 26 of the cylinder housing 22 for cleaning.

Figure 7:
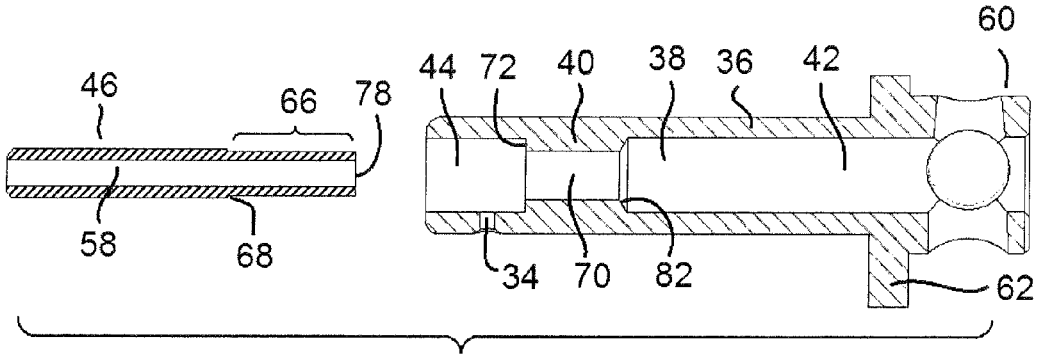
FIGS. 7-9 illustrate a series of operations in a method of assembling a flow control valve according to an embodiment of the present invention.
Figure 8:
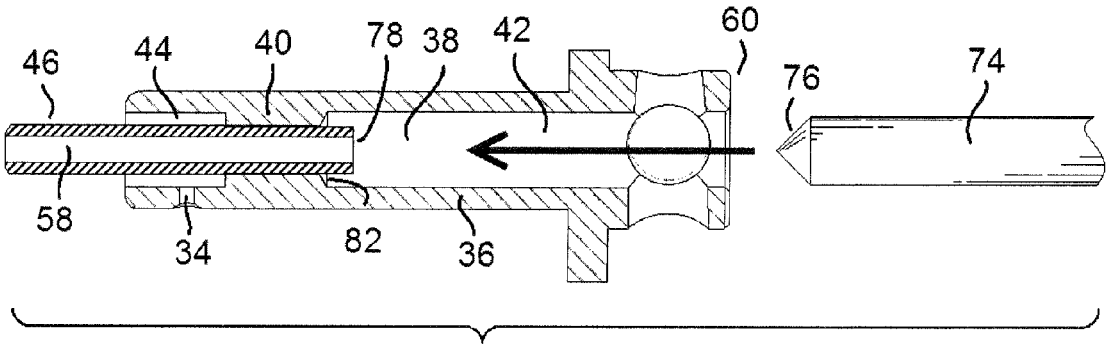
Figure 9:
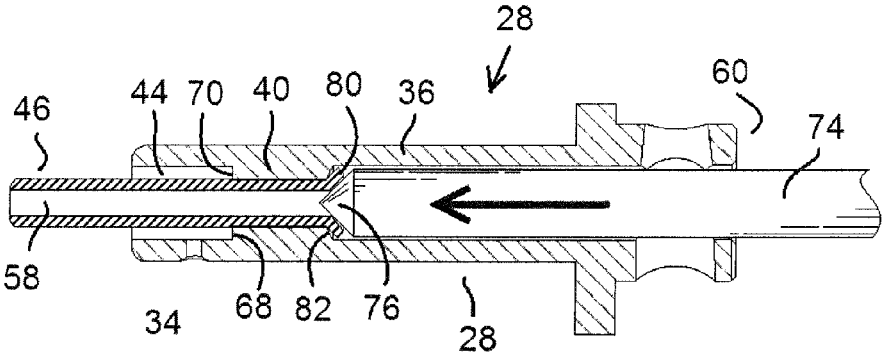

Referring now to FIGS. 7-9, therein is illustrated a series of steps for manufacturing a gas flow control valve assembly 28 according to a method of the present invention. As shown in FIG. 7, the tubular extension 46 may be fabricated from a piece of tubular material with a first portion 66 having a slightly reduced outside diameter to form an annular shoulder 68 at a position intermediate of its opposite open ends. This reduced outside diameter portion 66 may be configured to closely fit into a bore 70 provided in the bulkhead portion 40 of the control valve body 36. When inserted, the annular shoulder 68 will abut an edge 72 of the bulk head bore 70, preventing further insertion. This stage is depicted in FIG. 8.

Holding the tubular extension 46 in place in the control valve body 36, a mandrel or flaring tool (represented schematically at 74) having a beveled or pointed end 76 may be inserted into the forward chamber 42 of the through-passage way 38 in the control valve body 36. The beveled or pointed end 76 will center in an open end of the tubular extension passage way 58. Applying sufficient axial force thereon, a portion of the tubular extension 46 at the forward open end 78 is expanded or swaged, creating a flared end 80 that tightly engages a forward edge 82 of the bore 70 through the bulkhead portion 40, causing the tube to be firmly assembled with the control valve body 36 to create the gas flow control valve assembly 28. This method of assembly creates a firm junction while maintaining an axially aligned position of the tubular extension 46.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm gas operating system, comprising:

a barrel having an axial bore and a gas port;

a gas block on the barrel having a gas block passageway operatively connected with the gas port, the gas block including a cylinder housing extending axially substantially parallel to the barrel bore and open at forward and rear ends;

a gas actuation piston insertable through the open forward end of the cylinder housing to operably reciprocate in the cylinder housing between a forward at rest position and a rearward actuated position, the piston having a head portion with a recess including an open forward end and closed rearward end;

a switchable gas control valve insertable into the open forward end of the cylinder housing, the valve including a central passageway open at forward and rear ends, a plurality of separate gas flow control orifices selectively positioned to control gas flow from the gas block passageway to an interior chamber in the cylinder housing defined between the control valve and gas actuation piston; and a tubular extension open at opposite ends and axially extending rearward from the gas control valve, the tubular extension being configured to be received by the open forward end of the piston head portion recess;

wherein, gas pressure from the barrel bore causes the piston to reciprocate from its forward position, where the head portion recess extends over and occludes the tubular extension, to its rearward position, where the head portion recess disengages from the tubular extension, allowing gas to exhaust through the tubular extension and forward end of the control valve to atmosphere.

2. The firearm of claim 1, further comprising an operating rod for transferring axial rearward movement of the gas actuation piston to cycle the firearm.

3. The firearm of claim 1, wherein the gas flow control orifices extend radially and are circumferentially positioned on the gas control valve.

4. The firearm of claim 3, wherein the gas control valve is rotatable to selectively switch between each of the plurality of gas flow control orifices.

5. The firearm of claim 1, wherein an annular chamber in gas flow communication with the gas flow control orifices is defined within the gas control valve and around at least a portion of the tubular extension.

6. A method of assembling the firearm of claim 1, comprising;

providing the central passageway of the gas control valve with a bulkhead defining forward and rearward portions of the central passageway, the bulkhead having a bore therethrough;

providing a tubular extension member having a first exterior portion with a first diameter sized to closely fit the bore of the bulkhead and a second exterior portion axially spaced from the first portion and having a second diameter greater than the first diameter with an annular shoulder defined between the first and second exterior portions;

inserting the first exterior portion of the tubular extension member through the bulkhead bore from the rearward portion of the central passageway such that the annular shoulder abuts the bulkhead; and flaring a portion of the first exterior portion extending through the bulkhead bore to secure the tubular extension member to the gas control valve.

* * * * *